US010487679B2

(12) United States Patent
Bagdonis

(10) Patent No.: US 10,487,679 B2
(45) Date of Patent: Nov. 26, 2019

(54) METHOD AND APPARATUS FOR SEALING COMPONENTS OF A GAS TURBINE ENGINE WITH A DIELECTRIC BARRIER DISCHARGE PLASMA ACTUATOR

(71) Applicant: UNITED TECHNOLOGIES CORPORATION, Farmington, CT (US)

(72) Inventor: Guthrie Bagdonis, Marlborough, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 256 days.

(21) Appl. No.: 15/651,745

(22) Filed: Jul. 17, 2017

(65) Prior Publication Data

US 2019/0017406 A1 Jan. 17, 2019

(51) Int. Cl.
*F01D 11/20* (2006.01)
*F01D 11/10* (2006.01)

(52) U.S. Cl.
CPC ..... *F01D 11/20* (2013.01); *F01D 11/10* (2013.01); *F05D 2270/172* (2013.01)

(58) Field of Classification Search
CPC ..... F01D 11/20; F01D 11/101; F01D 11/025; F01D 11/10
See application file for complete search history.

(56) References Cited

U.S. PATENT DOCUMENTS 5,669,583 A * 9/1997 Roth ..... B63B 1/34 244/130
6,027,306 A * 2/2000 Bunker ..... F01D 5/20 415/115
6,419,446 B1 * 7/2002 Kvasnak ..... F01D 5/145 415/116
6,676,802 B2 * 1/2004 Roth ..... A61L 2/14 118/715
6,976,824 B2 * 12/2005 Nottin ..... F01D 5/20 415/115
7,134,842 B2 * 11/2006 Tam ..... F01D 5/143 416/193 A
7,183,515 B2 * 2/2007 Miller ..... B64C 23/005 219/121.5
7,255,062 B1 * 8/2007 Higman ..... H05H 1/46 118/723 AN (Continued)

*Primary Examiner* — Hung Q Nguyen
(74) *Attorney, Agent, or Firm* — Cantor Colburn LLP

(57) ABSTRACT

A system and method for aerodynamically sealing rotating and fixed components of a gas turbine engine. The system includes a gas turbine engine having a casing and a rotating portion, a plasma actuator having a first and a second electrodes, the first electrode including at least one section of substantially flat conductive material encased in a dielectric material forming at least a portion of a cylinder disposed circumferentially on the casing. The system also includes the rotating portion operably configured as the second electrode, and an excitation source operably connected between the first electrode and the second electrode, the excitation source generating an excitation signal and applying it to the first and second electrodes to cause the actuator to form a plasma between the first and second electrodes, the plasma inducing an airflow between the casing and the rotating portion.

21 Claims, 7 Drawing Sheets

(56) References Cited

U.S. PATENT DOCUMENTS 7,304,396 B2 * 12/2007 Haje ..... F01D 15/10 290/1 R
7,351,035 B2 * 4/2008 Deschamps ..... F01D 5/20 416/92
7,380,756 B1 * 6/2008 Enloe ..... B64C 23/005 244/130
7,410,532 B2 * 8/2008 Krichtafovitch ..... H01J 49/04 250/423 R
7,494,319 B1 * 2/2009 Liang ..... F01D 5/20 416/92
7,819,626 B2 10/2010 Lee et al.
8,585,356 B2 11/2013 Wiebe et al.
2004/0011917 A1 * 1/2004 Saeks ..... B64C 21/04 244/1 N
2006/0005545 A1 * 1/2006 Samimy ..... F01D 25/30 60/772
2007/0258810 A1 * 11/2007 Aotsuka ..... F01D 5/143 415/206
2008/0067283 A1 * 3/2008 Thomas ..... B64C 21/00 244/1 N
2008/0089775 A1 * 4/2008 Lee ..... F01D 11/20 415/13
2008/0101913 A1 * 5/2008 Lee ..... F01D 5/145 415/1
2008/0128266 A1 * 6/2008 Lee ..... F01D 5/186 204/164
2008/0131265 A1 * 6/2008 Lee ..... F01D 5/186 415/116
2008/0145210 A1 * 6/2008 Lee ..... F01D 5/143 415/176
2008/0145233 A1 * 6/2008 Lee ..... F01D 5/145 416/96 R
2009/0065064 A1 3/2009 Morris et al.
2009/0169356 A1 * 7/2009 Wadia ..... F04D 27/001 415/26
2009/0169363 A1 * 7/2009 Wadia ..... F04D 27/001 415/118
2010/0183424 A1 * 7/2010 Roy ..... F01D 5/20 415/1
2010/0284795 A1 11/2010 Wadia et al.
2015/0267727 A1 9/2015 Segawa et al.

* cited by examiner

METHOD AND APPARATUS FOR SEALING COMPONENTS OF A GAS TURBINE ENGINE WITH A DIELECTRIC BARRIER DISCHARGE PLASMA ACTUATOR

TECHNICAL FIELD

The present disclosure relates generally to systems and methods for gas flow in a gas turbine engine. More specifically, the present disclosure relates to a method and apparatus for plasma actuator applications for controlling gas flow and implementing gas seals in a gas turbine engine.

BACKGROUND

Dielectric Barrier Discharge Plasma Actuators (DBDPA) are generally comprised of two electrodes, commonly conductor strips, located offset of one other and separated by a dielectric insulating layer. A high voltage source energizes both electrodes such that the voltage potential ionizes ambient air inducing a plasma state, which is then accelerated linearly in the intended direction based on the offset of the two electrodes. In wind tunnel tests, the application has been demonstrated for many applications on cylinders and airfoils. When applied to an airfoil, boundary separation of laminar airflow can be reduced in high angle of attack conditions when blade stall would normally occur.

DBDPA has been utilized to enhance operating efficiency, and improve blade stall characteristic in gas turbine engine operation applications. One DBDPA construction application includes the placement of DBDPA located about the circumference of the engine case to affect localized airflow, particularly to inhibit blade tip leakage. However, the usage of the conventional DBDPA construction technique also comes with the major durability limitation associated with conventional DBDPA usage. The continued use of DBDPA, over time, produces localized heat concentrations which accelerate the degradation of the dielectric barrier, eventually resulting in complete failure. Slight discrepancies in the dielectric barrier, however minute, exaggerate failure as the plasma concentrates in those areas due to the static nature of conventional DBDPA operation. Other configurations that employ non-uniform structures for the electrodes also result in plasma concentrations and non-uniform plasma generation. What is needed is a dielectric barrier plasma actuator that provides a uniform plasma and avoids degradation of the dielectric barrier and localized heat concentrations.

BRIEF DESCRIPTION

According to an embodiment, described herein is a system and method for aerodynamically sealing rotating and fixed components of a gas turbine engine. The system includes a gas turbine engine having a casing and a rotating portion, a plasma actuator having a first and a second electrodes, the first electrode including at least one section of substantially flat conductive material encased in a dielectric material forming at least a portion of a cylinder disposed circumferentially on the casing. The system also includes the rotating portion operably configured as the second electrode, and an excitation source operably connected between the first electrode and the second electrode, the excitation source generating an excitation signal and applying it to the first and second electrodes to cause the actuator to form a plasma between the first and second electrodes, the plasma inducing an airflow between the casing and the rotating portion.

In addition to one or more of the features described above, or as an alternative, further embodiments may include that the disposing includes applying the first electrode to at least a portion of an inner circumference of the casing.

In addition to one or more of the features described above, or as an alternative, further embodiments may include that the disposing includes placing the first electrode offset axially of the second electrode, and thereby the plasma generated induces an airflow forward axially.

In addition to one or more of the features described above, or as an alternative, further embodiments may include that the plasma is substantially uniform in at least one of a circumferential and axial direction.

In addition to one or more of the features described above, or as an alternative, further embodiments may include that the generating includes providing an alternating current (AC) signal to the actuator, and wherein the (AC) signal exhibits a frequency determined to provide optimal DBDPA output.

In addition to one or more of the features described above, or as an alternative, further embodiments may include that the rotating portion is at least on one of a fan blade, a compressor blade, a turbine blade, and a raised portion on a spool.

In addition to one or more of the features described above, or as an alternative, further embodiments may include executing a method to control excitation signal to the actuator to control and manipulate the plasma generated and thereby the airflow induced, wherein the control is based on an operating condition of the gas turbine engine.

In addition to one or more of the features described above, or as an alternative, further embodiments may include measuring an operating parameter of the gas turbine engine.

In addition to one or more of the features described above, or as an alternative, further embodiments may include diagnosing a condition of the gas turbine engine based on at least the measuring of an operating parameter of the gas turbine engine.

In addition to one or more of the features described above, or as an alternative, further embodiments may include that the diagnosing includes at least one of collecting data over time to facilitate making lifetime predictions of performance of the gas turbine engine.

Also described herein in one or more embodiments is a system for aerodynamically sealing rotating and fixed components of a gas turbine engine. The system includes a gas turbine engine having a casing and a rotating portion, a dielectric barrier discharge plasma actuator having a first electrode and a second electrode, the first electrode disposed circumferentially on the casing of the gas turbine engine, the first electrode comprising at least one section of substantially flat conductive material encased in a dielectric material generally forming at least a portion of a cylinder, and a rotating portion configured as the second electrode. The system also includes an excitation source operably connected between the first electrode and the second electrode, the excitation source generating an excitation signal and applying it to the first and second electrode to cause the actuator to form plasma between the first and second electrode, the plasma inducing an airflow between the casing and the rotating portion.

In addition to one or more of the features described above, or as an alternative, further embodiments may include that the first electrode is disposed on at least a portion of an inner circumference of the casing.

In addition to one or more of the features described above, or as an alternative, further embodiments may include that the rotating portion is including a plurality of stages of a plurality of rotating blades.

In addition to one or more of the features described above, or as an alternative, further embodiments may include that, the plasma is substantially uniform in at least one of a circumferential and axial direction.

In addition to one or more of the features described above, or as an alternative, further embodiments may include a controller operably connected to at least one of the actuator, the excitation source, and a plurality of sensors configured to measure an operating parameter of the gas turbine engine.

In addition to one or more of the features described above, or as an alternative, further embodiments may include that the controller includes the excitation source.

In addition to one or more of the features described above, or as an alternative, further embodiments may include the controller executing a method to control excitation signal to the actuator to control and manipulate the plasma generated and thereby the airflow induced, wherein the control is based on an operating condition of the gas turbine engine.

In addition to one or more of the features described above, or as an alternative, further embodiments may include the controller executing a method to diagnose a condition of the gas turbine engine based on at least the measuring of an operating parameter of the gas turbine engine.

In addition to one or more of the features described above, or as an alternative, further embodiments may include that the diagnosing includes at least one of collecting data over time to facilitate making lifetime predictions of performance of the gas turbine engine.

Additional features and advantages are realized through the techniques of the present disclosure. Other embodiments and aspects of the disclosure are described in detail herein. For a better understanding of the disclosure with the advantages and the features, refer to the description and to the drawings.

BRIEF DESCRIPTION OF THE DRAWINGS

The subject matter which is regarded as the disclosure is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

Figure 1:
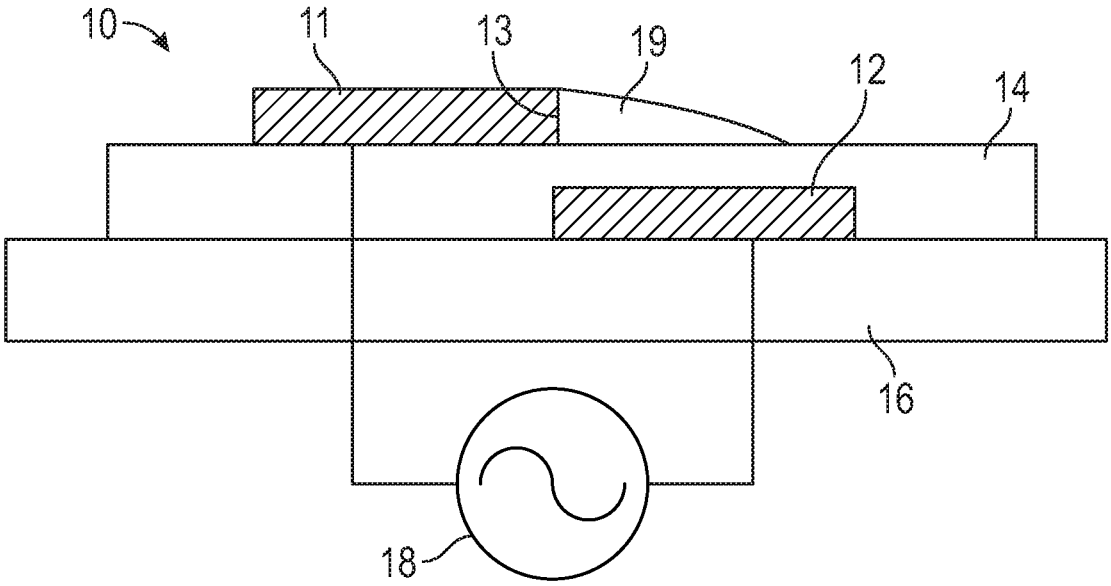
FIG. 1 depicts a simplified block diagram of a conventional dielectric barrier plasma actuator.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended. The following description is merely illustrative in nature and is not intended to limit the present disclosure, its application or uses. It should be understood that throughout the drawings, corresponding reference numerals indicate like or corresponding parts and features. As used herein, the term controller refers to processing circuitry that may include an application specific integrated circuit (ASIC), an electronic circuit, an electronic processor (shared, dedicated, or group) and memory that executes one or more software or firmware programs, a combinational logic circuit, and/or other suitable interfaces and components that provide the described functionality.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two. i.e. two, three, four, five, etc. The term "connection" can include an indirect "connection" and a direct "connection".

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in Figure X may be labeled "Xa" and a similar feature in Figure Z may be labeled "Za." Although similar reference numbers may be used in a generic sense, various embodiments will be described and various features may include changes, alterations, modifications, etc as will be appreciated by those of skill in the art, whether explicitly described or otherwise would be appreciated by those of skill in the art.

According to one embodiment, described herein is a system and method for application of a plasma actuator having strips or sheet sections for the high voltage electrode about the internal circumference of the engine case, where rub strips would normally be located in close proximity to rotating airfoil tips. The tip of the airfoil is grounded and the high voltage excitation is applied establishing a plasma field between the strips on the case and the blade tips as they rotate. Advantageously this application of the described embodiments both eliminates the use of nib strips, and possibility of blade tip rub, and achieves the effects of reduced tip-to-case clearances by creating a plasma barrier which would allow design engineers to increase tip-to-case clearances while maintaining and/or increasing efficiency. Tip gap leakage could be reduced and/or eliminated, and thereby maximizing compressor and turbine section effectiveness and efficiency.

It will be appreciated by one of ordinary skill in the art that while the disclosed examples are directed to a compressor and turbine casing for a gas turbine engine, the disclosed tip clearance flow control may be utilized to provide tip clearance flow control to any suitable axial flow device, including, but not limited to, fans, turbines, pumps, jet engines, high speed ship engines, power stations, superchargers, low pressure compressors, high pressure compressors, low pressure turbines, high pressure turbines, and/or any other application.

Referring to FIG. 1, an example of a single dielectric barrier discharge plasma actuator DBDPA 10 is shown. As shown in FIG. 1, a plasma actuator 10 includes an exposed electrode 11 and an enclosed electrode 12 separated by a dielectric barrier material 14. The electrodes 11, 12 and the dielectric material 14 may be mounted, for example, to a substrate 16. A high voltage AC power supply 18 is electrically coupled to the electrodes 11, 12. It will be understood that the exposed electrode 11 may be at least partially covered, while the enclosed electrode 12 may be at least partially exposed. During operation, when the amplitude of the applied AC voltage from the AC Power supply is large enough, the air will locally ionize in the region of the largest electric field (i.e., potential gradient) forming plasma 19. The plasma 19 generally forms at an edge 13 of the exposed electrode 11 and is accompanied by a coupling of directed momentum to the surrounding air. For example, the formation of the plasma 19 introduces steady or unsteady velocity components in the surrounding air that form the basis of the disclosed flow control strategies as will be described below.

The induced velocity by the plasma 19 can be tailored through the design of, and the arrangement of the electrodes 11, 12, which controls the spatial electric field. For example, various arrangements of the electrodes 11, 12 can produce wall jets, span-wise vortices or stream-wise vortices, when placed on the wall in a boundary layer. The ability to tailor the actuator-induced flow by the arrangement of the electrodes 11, 12 relative to each other and to the flow direction allows one to achieve a wide variety of actuation strategies for compressor casing treatments.

To maintain the plasma 19, in this example an applied AC voltage from the power supply 18 is required. In the illustrated example, the plasma 10 can sustain a large volume discharge at atmospheric pressure without arcing because it is self-limiting. In particular, during the half-cycle for which the exposed electrode 11 is more negative than the surface of the dielectric 14 and the covered electrode 12, and assuming a sufficiently large potential difference, electrons are emitted from the exposed electrode 11 and terminate on the surface of the dielectric 14. The buildup of surface charge on the dielectric 14 opposes the applied voltage and gives the plasma 19 discharge its self-limiting characteristic. That is, the plasma 19 is extinguished unless the magnitude of the applied voltage continuously increases. On the next half-cycle, the charge available for discharge is limited to that deposited on the dielectric surface during the previous half-cycle and the plasma 19 again forms as it returns to the exposed electrode 11.

As described above, the need to manipulate the blade tip clearance flow may be transient in nature, particularly with different modes of operation of the engine 20. For example, the need to manipulate the blade tip clearance flow may be greatest during times of compressor stress or load (i.e., low mass flow rates), such as, for example, during take-off and/or landing of a jet aircraft. In the described embodiments, surface mounted DBDPA actuators 10 are used to control compressor rotor blade tip clearance flow by active means. In an embodiment, the plasma actuators 10 may be flush mounted to the wall or casing 25 (See FIG. 2) surrounding a blade in a gas turbine engine 20, producing little or no effect on flow through the compressor when not actuated. In other words, the plasma casing treatment will not cause a loss in design operating point efficiency, and in fact may significantly improve performance by avoiding or reducing the need for conventional rubbing type seals. Furthermore, the plasma casing treatment may be implemented in an open or closed loop for control of rotational sealing. An example open loop implementation energizes or de-energizes the DBDPA 10 based upon the corrected speed and corrected mass flow of the compressor. An example closed loop implementation utilizes a sensor or sensors to monitor the compressor aerodynamics, synthesizing a stability state variable. The plasma actuators 10 are selectively energized or de-energized to drive the fluid flow away from stall.

Figure 2:
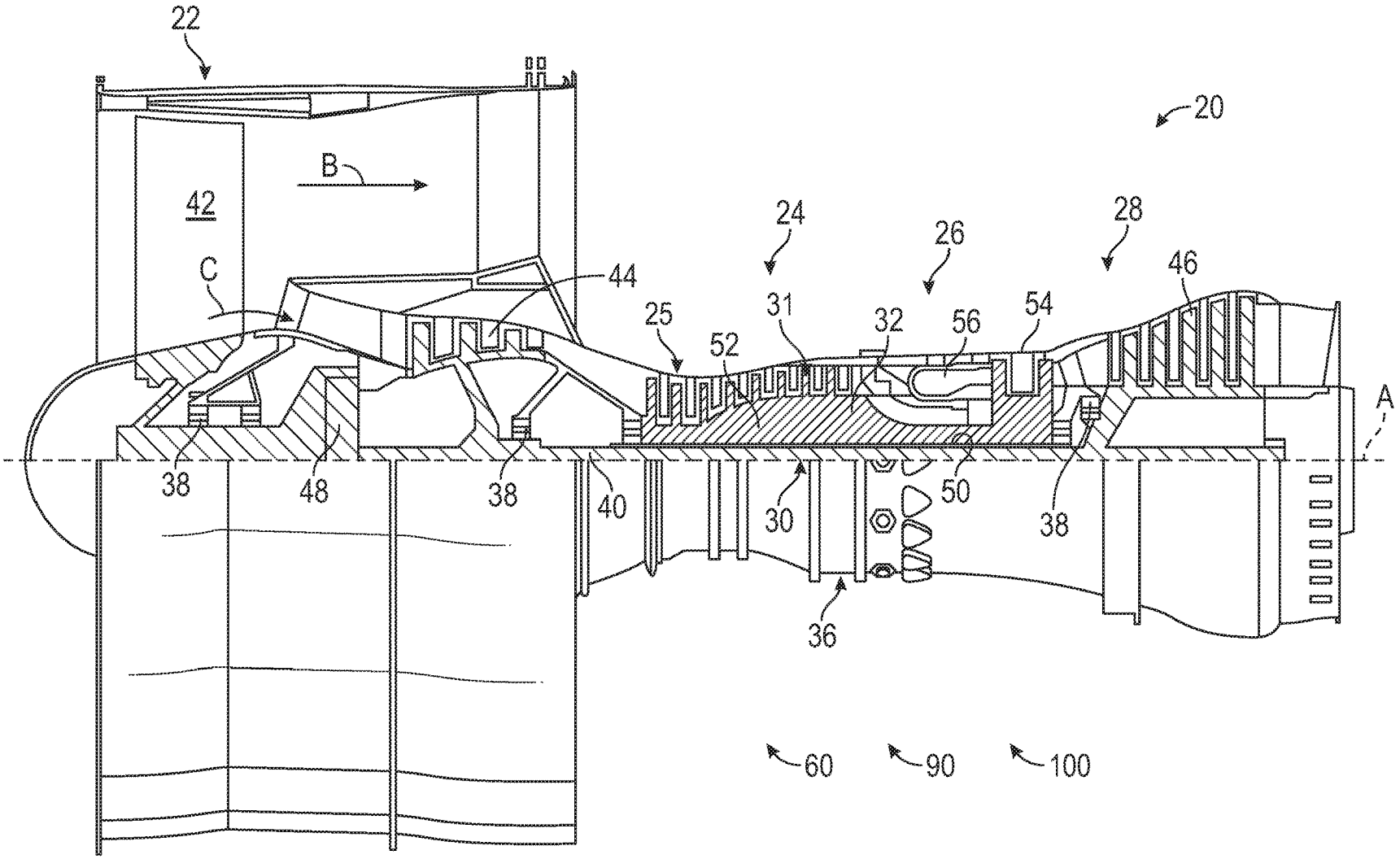
FIG. 2 depicts a simplified partial cutaway of a gas turbine engine as employed in the embodiments.

FIG. 2 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including single and three-spool architectures.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, geared architecture 48 may be located aft of combustor section 26 or even aft of turbine section 28, and fan section 22 may be positioned forward or aft of the location of gear system 48.

The aircraft engine 20 in one example is a high-bypass geared turbofan engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10.1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

The engine 20 may typically employ a variety of subsystems for operation. For example in an embodiment the engine 20 may employ a fuel subsystem shown generally as 60, electrical and sensing subsystems, shown generally as reference numeral 90, a control subsystem shown generally as 100, and the like. A fuel subsystem 60 may include the various tubing, piping, filters, screens, controls, pumps, valves, sensors and the like employed to deliver fuel as required for engine operation under a variety of conditions. The engine 20 may include and electronic engine control (EEC) system 100. Electronic engine control system 100 may include controls and interfaces for actuators, sensors and the like and a controller. For example, the control system 100 could be a Full Authority Digital Engine Control (FADEC) system. Further details on the control system 100 and the control processing are presented in detail below. Electrical and sensor subsystems 90 may interface with the fuel subsystem 60 and control system 100 in any of a variety ways to detect and measure the operation of the engine 20. The sensors employed in the engine 20 may include, but not be limited to temperature, pressure, flow, speed and position sensors, a contamination sensor in accordance with an embodiment, and the like.

Figure 3:
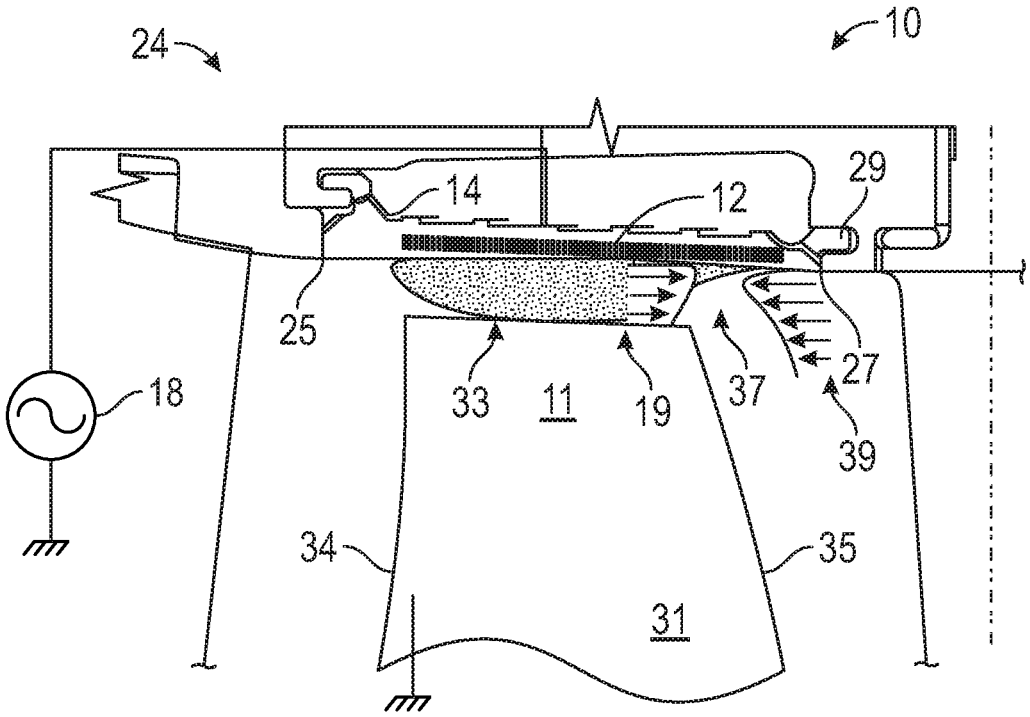
FIG. 3 is a simplified diagram depicting a dielectric barrier plasma actuator applied in a gas turbine in accordance with an embodiment.
Figure 3:
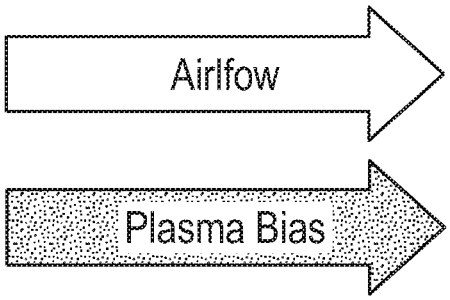

Turning now to FIG. 3, an example partial view of a compressor section 24 is shown in greater detail. The compressor section 24 includes a surrounding wall or casing 25 having a radially inward facing surface 27 and a radially outward facing surface 29. A plurality of axially spaced rows of rotor blades 31 extend outwardly from the high speed spool 32 across the flow path into proximity with the casing 25. Each rotor blade 31 is generally contoured to an airfoil cross section and includes a leading edge 34 and a trading edge 35. While the embodiments are described herein with respect to the compressor section 24 and turbine section 46, it will be appreciated that the described embodiments are readily applicable to virtually any section of the gas turbine engine 20 where an airflow seal is needed.

In the illustrated example of FIG. 3, a plasma actuator(s) 10 is mounted circumferentially to the casing 25 in series. In this example, one of the electrodes 12 is embedded within the casing 25, while tip 33 of the fan, compressor or turbine blade 31 acts as the other electrode 11. The electrode 12 mounted on the casing is configured as a plate or series of plates substantially forming a cylinder around the circumference of the casing 25. In this configuration, when an AC electric field if applied, the plasma 19 forms on the inner surface 27 of the casing 25. In addition, an array of electrodes 12 may be mounted in series axially to have stages of DBDPA 10. While the description provided regarding the various embodiments is made with respect to a substantially cylindrical electrode or electrodes 12 it should be appreciated that that need not be considered limiting. In some embodiments, it may be possible that the electrode 12 and DBDPA 10 only cover at least a portion of the inner surface 27 of the casing 25 circumferentially. That is, the actuators 10 may extend partially or completely around the circumference of the inner surface 27 of the casing 25 to provide greater coverage of the surface 27. It will be understood, however, that the plasma actuator(s) 10 may be strategically placed anywhere along the inner surface 27 of the casing 25, and in any arrangement. Furthermore, the plasma actuators 10 may be located in any suitable location along the casing 25, including, for instance, proximate to the fan section 22 with the fan blade 42 operating as an electrode 11 as shown on the low pressure compressor 44, the high pressure compressor sections 24 turbines 54 and 46, or any other location and may include as few as a single actuator 10.

Figure 4:
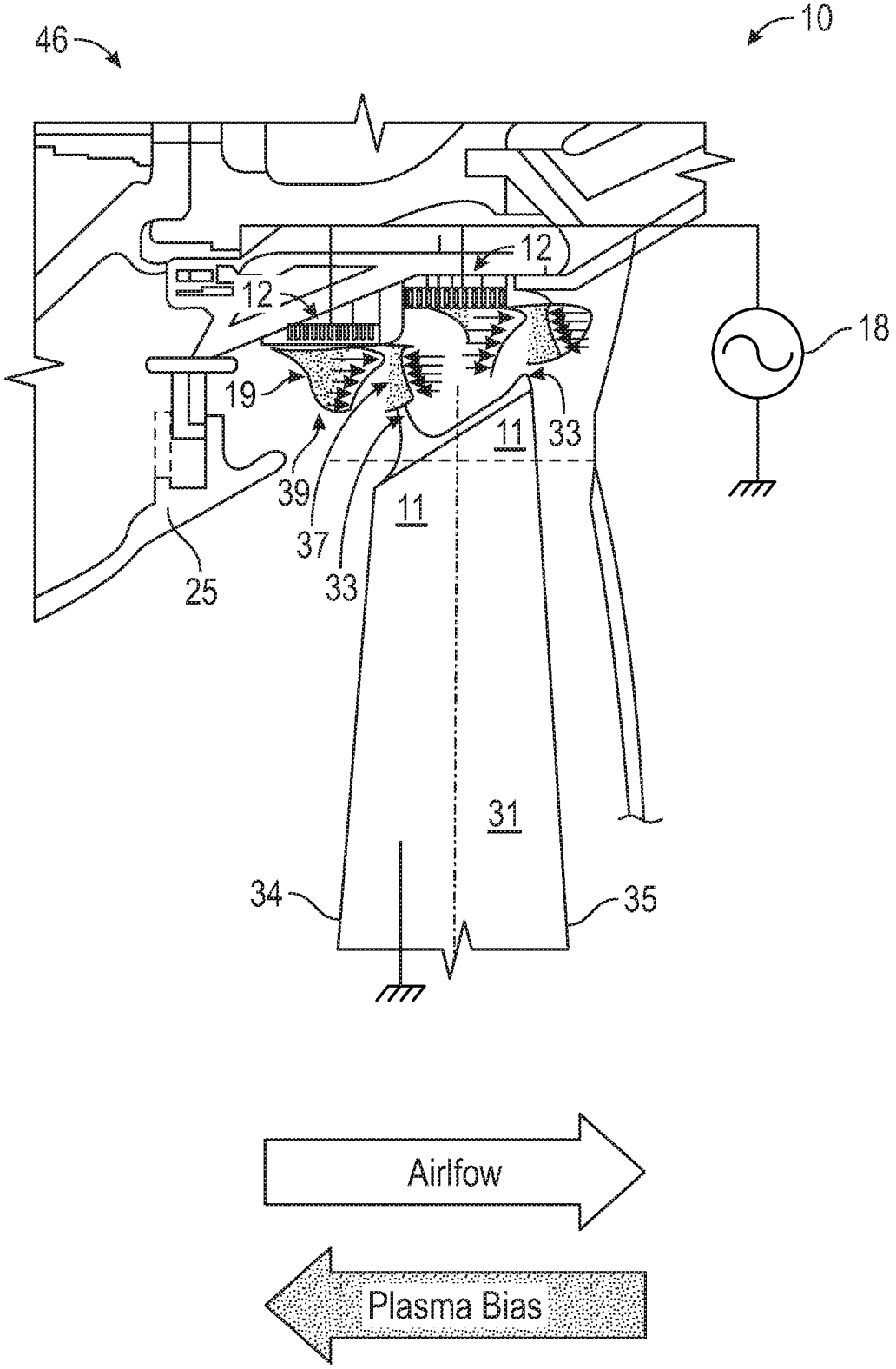
FIG. 4 is a simplified diagram depicting a dielectric barrier plasma actuator applied in a gas turbine in accordance with an embodiment.
Figure 5:
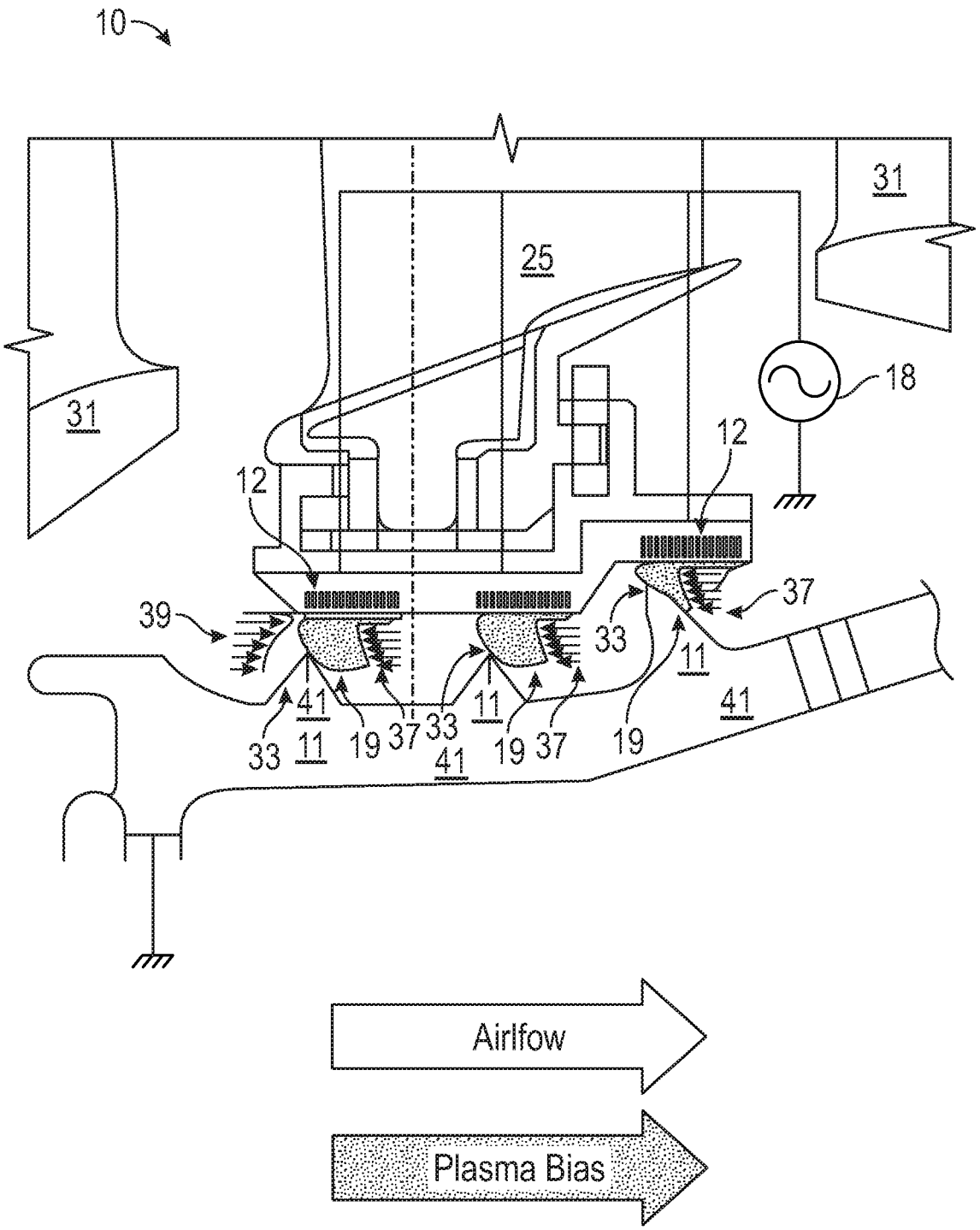
FIG. 5 is a simplified diagram depicting a dielectric barrier plasma actuator applied in a gas turbine in accordance with an embodiment.

The example DBDPA 10 utilizes an AC voltage power supply 18 for its excitation. However, if the frequency associated with the AC signal driving the formation of the plasma 30 is sufficiently high in relation to any relevant time scales for the flow, so that the associated aerodynamic force produced by the plasma 30 may be considered effectively steady state. Uniformity of the plasma is desirable to avoid concentration points in the plasma and localized heating. Moreover, uniformity in the plasma generated results in uniformly induced airflow shown generally as 37 and high effectiveness in offsetting blade tip vortices and leakage, shown generally as 39, past the ends of the rotor blade tips 33 for each successive compressor or turbine stage in the gas turbine 20. In an embodiment, the electrode 12 is configured as a planar strip or sections of strips distributed around the circumference of the casing 25. When excited from the excitation source 18, the electrode 12 interacting with the electrode 11 (as part of the blade 31) results in a plasma being generated about the entire circumference of the casing between the path of the tips 33 and electrode 11 and the casing and electrode 12. The resulting plasma inducing the airflow 37. Careful selection of the geometry of the actuator 10 as integrated in the engine 20 facilitates directing the airflow accordingly. As depicted in FIG. 3 in a fan section or compressor section where the primary airflow path is to the right as shown, and higher pressure is aft or to the right as depicted, the electrode 12 is disposed aftward of the electrode 11 e.g., the rotor blade 31 and thus the airflow 37 induced by the plasma actuator 10 are directed to the right as shown. Conversely, in applications in the turbine section 46 where the higher pressure is forward of the turbine blades 31, the actuator is configured the opposite, with the electrode 12 disposed forward relative to the electrode 11 of the blade 31. In this instance the plasma 19, and thereby the airflow 37 induced by the plasma 19 from the actuator 10 is directed in the opposite direction forward to oppose leakage through the turbine section 46. FIG. 4 depicts an example of the actuator applied in the turbine section 46. Likewise, FIG. 5 depicts a similar configuration to FIG. 4 but sealing the casing to the rotor or spools 30 and 32 between blade sets. In this embodiment a raised portion 41 or "knife edge" about the circumference of the spools 30, 32 (at the roots of the blades) of the rotor operates as the electrode 11. The plasma 19 forming between the raised portion 41 acting as the electrode 11 and the electrode 12 of the actuators 10 when the excitation 18 is applied.

Due to the dynamic nature of the rotor blade tip 33 and its rotational relation to any part of the case 25 at a given time, plasma and heat concentrations are significantly reduced resulting in increased durability compared to the conventional DBDPA 10 construction method. In operation, as the blade tip 33 moves, the plasma 19 corona constantly regenerates with the moving rotor blade 31. Conversely in conventional plasma actuator designs were the electrodes are fixed, the plasma 19 is allowed to stagnate, thereby potentially degrading the dielectric barrier 14. Advantageously the feature of the DBDPA 10 construction of the described embodiments permits utilization of less exotic materials in DBDPA 10 construction and significantly increases dielectric material durability such that it becomes point practical for utilization in constant engine operation with life cycles matching existing gas turbine engine 20 components.

U.S. Patent application US20150267727 to Segawa et al., discloses a similar technology as applied to a gas turbine engine. However in that application the high voltage electrode in the casing is an insulated wire wrapped around the casing in a plurality of turns. While this may be advantageous in some application as described therein, it results in an apparent non-uniformity in the plasma generated because the electrodes are not uniform in cross section. Wire electrodes, and the gaps between them where the insulation in would generate an uneven plasma field which contains areas of concentrated plasma (high heat) and areas where the field is weakened, creating a non-optimal tip-gap seal. Areas of concentrated plasma have significant influence on accelerating the degradation of the dielectric barrier, potentially negating any benefit of the rotating dynamic plasma field increasing the durability of the dielectric barrier. One way this non-uniformity was addressed in Segawa et al was to trim both leading and trailing edges of the rotor blade to influence a more uniform plasma field towards the center of the airfoil. Removing this material on the airfoil edges could have a detrimental effect on aerodynamic performance of the rotor blade, and possibly would render the utilization of such a wire-based plasma actuator ineffective in practicality.

Figure 6:
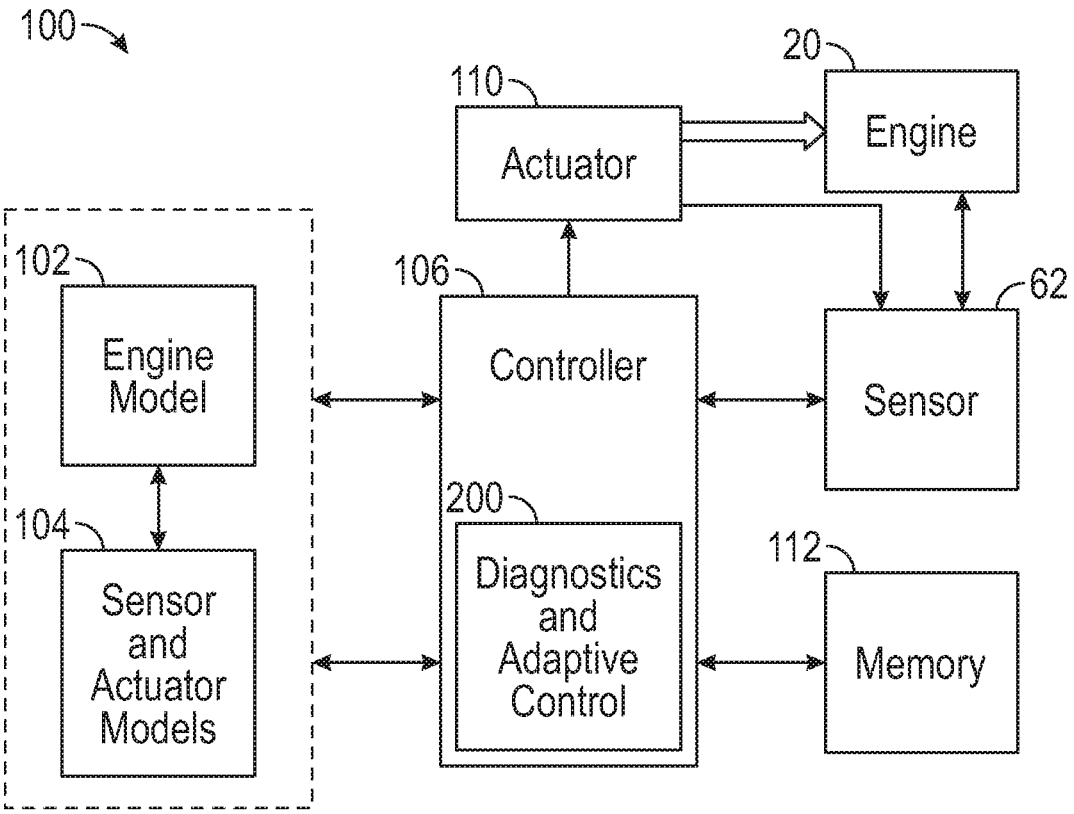
FIG. 6 is a simplified block diagram of an engine control system in accordance with an embodiment.

FIG. 6 illustrates an exemplary embodiment of an engine control system 100 including optional model based control, as may be employed with engine 20. As shown in FIG. 6, system 100 includes engine 20, an actuator 110. (for example, plasma actuator 10 as described herein, with the reference number incremented by 100) and a sensor 62 that is communicatively coupled with a processor or controller 106. In an embodiment, sensor 62 is any of a variety of sensors employed in the engine including temperature, pressure, flow, speed and position sensors, and the like. In this embodiment, and for the purposes of description of the embodiments herein, the sensor 62 might be pressure and/or flow sensors as supplied to the engine 20 configured to evaluate the performance of the DBDPA 110. Other types of suitable sensors (e.g., flow meters and speed sensors) could also be used.

In operation of the engine 20, the processor 106 is communicatively coupled to the actuator 110 to provide commands to control the engine 20. In an embodiment actuator 110 is a DBDPA 10 applied as a rotor blade 31 air seal as described above In addition optionally, the processor 106 is operatively coupled to a memory 112, sensor and actuator models 104, and an engine model 102. The sensor and actuator models 104 are associated with any of the sensor(s) 62 and actuator(s) 110, and, in this embodiment, are communicatively coupled with the optional engine model 102. Alternatively, functionality associated with a sensor and actuator models 104 may be an integrated with an engine model 102 in other embodiments to form a system model. Further, in other embodiments, engine model(s) 102 and/or sensor and actuator model(s) 104 may be integrated into various components such as, for example, into an Electronic Engine Control (EEC) system, such as a Full Authority Digital Engine Control (FADEC) system such as system 100. In an exemplary embodiment, the FADEC may be physically attached to the gas turbine engine 20.

In operation, the sensor 62 monitors an engine or operating parameter, such as temperature, pressure, flow, vane or actuator position, and the like, and provides data corresponding to the parameter to the processor 106, which may store the data in memory 112. The processor 106 processes the data stored in the memory 112 and employs the data in various control algorithms and diagnostics. In some embodiments, where model based control is employed, the processor 106 may compare data from the sensor 62 to corresponding data of the sensor and actuator model 104. If the difference between the measured data of the sensor 62 and the reference data of the actuator model 104 is outside of a threshold value, the processor 106 may take various steps to address the difference including update the sensor and actuator model 104 with the data of the sensor 62, ignoring the difference between measured data and model data or other mitigation steps as discussed further herein. In addition, in an embodiment, by updating the reference data of the actuator model 104, degradation of the actuator 110, which may occur over time, can be accommodated.

Monitoring engine parameter data provides the basis for performing gas turbine engine performance tracking. The dynamic behavior of measurement devices, particularly detecting and quantifying the changes in the dynamic responses of measurement devices, is useful in performing gas turbine engine performance tracking. By monitoring sensor data based on transient behavior, steady-state behavior and trend data, degradation of engine actuators 110 may be detected that may not be perceived when the engine 20 is operating at steady-state alone. Ascertaining and distinguishing degraded performance trends may allow the engine model 102 and sensor and actuator model 104 to be updated in order to compensate for sensor degradation.

Using model-based control(s) allows the control system 100 to use all the information provided by the system model 102, 104, estimator, and diagnostic and adaptive control processes 200. The algorithm used herein allows the controller 106 to ascertain the performance of the engine 20 over time and while considering engine operating constraints. The control system 100K) can then modify selected control actions to ensure that the constraints are not violated while satisfying a given control objective. In other words, the control ideally can develop an improved, if not the best possible, solution to meet the mission requirements within the constraints presented.

The role of the diagnostics in the described embodiments is to detect, isolate, and identify any deterioration or degradation, fault, failure, or damage in the gas turbine engine system 20. In some embodiments, the diagnostic and adaptive control method 200 may be based on model-based diagnostics, or multi-model based diagnostics, where information from the other control components like the engine model 102 sensor model 104, and model structure, innovations, parameter updates, states, sensor values, sensor estimates, etc. are used to diagnose the engine and components. With such information, the diagnostics can determine if there is a fault, where the fault is located, and the magnitude of the fault, and then the controller can adjust the operation of the control system 100 accordingly.

Figure 7:
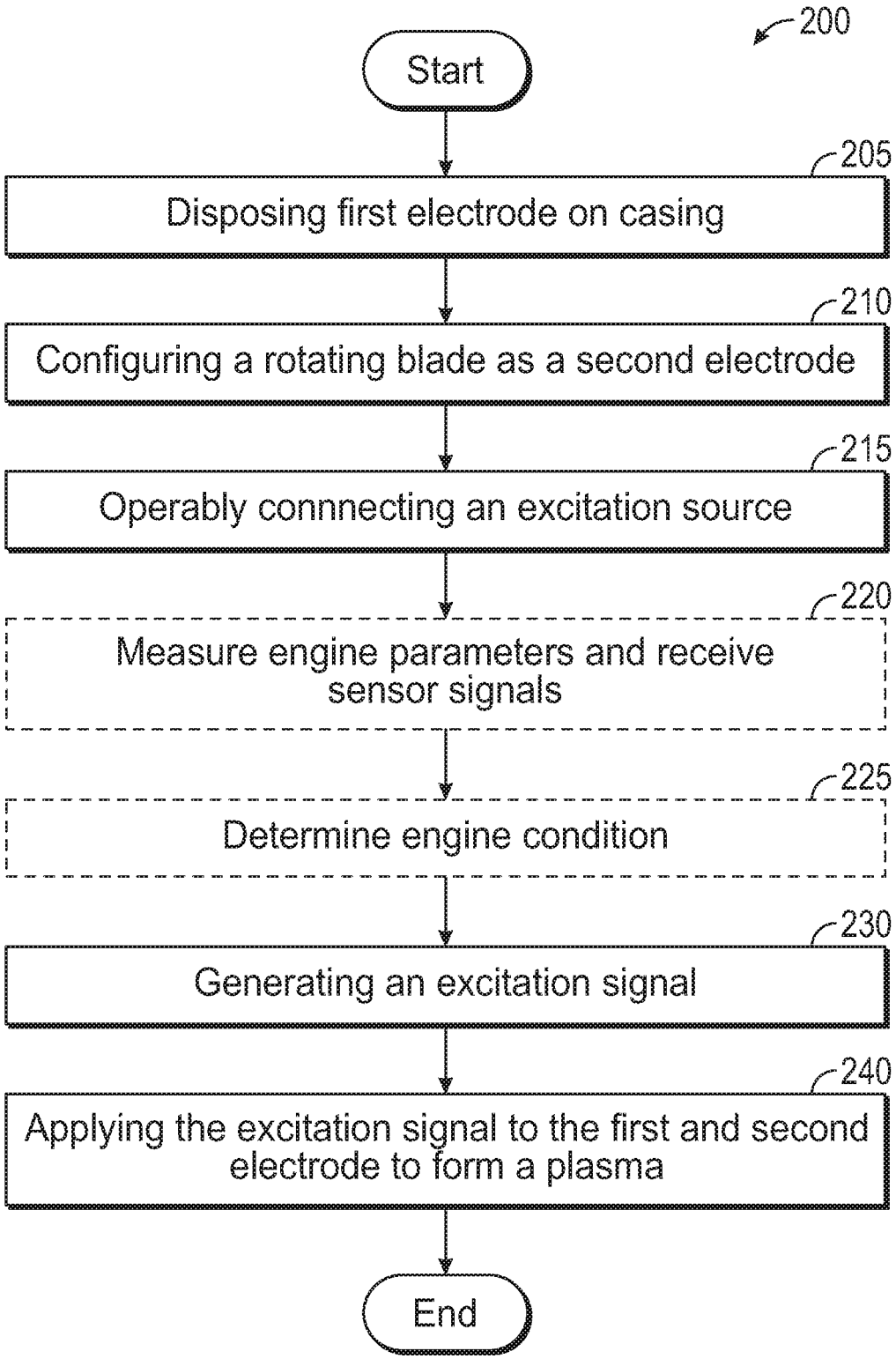
FIG. 7 depicts a flowchart of the method aerodynamic sealing of a gas turbine engine in accordance with an embodiment.

FIG. 7 depicts one of the control processes for observing data for a component, for example, sensor 62 and then employing the data in the control system 100. While in an embodiment description is made with reference to a sensor 62 and actuator 110, other components and systems, may be applicable. In an embodiment, the process performs a method for detection and control of sealing rotating components of an engine system by trending their measured response. The control system 100 then adapts to the detected conditions to improve performance of the control system 100 and the operation of the engine 20. In an embodiment the control method 200 includes, but is not limited to logic for identifying engine conditions by measuring temperatures, pressures and status of sensors with those corresponding to healthy or nominal engine performance values.

For example, in an embodiment, because ambient air becomes part of the dielectric barrier in the plasma actuator operation, it may also be possible to utilize a DBDPA 110 as a transducer as well to measure relative air densities and temperatures. Advantageously, this approach could facilitate monitoring any or all stages of the engine 20 where the DBDPA 110 is applied. In one embodiment, the DBDPA 110 may permit the elimination of other sensors 62 and probes while increasing the input and capability of conventional Health and Usage Monitoring Systems (HUMS) data down to the component level. As a result, engine operating parameters can be adjusted to improve engine efficiency while providing real time condition monitoring. Moreover, such data and monitoring facilitated by the application of a DBDPA 110 may facilitate reduced inspection intervals as well as benefit Maintenance, Repair, and Overhaul (MRO) operations by more accurately predicting part replacement thus reducing the effects of component lead-times.

These algorithms that can be executed periodically, similar to a Built-In-Test (BIT) or more often depending on the testing and data, particularly during selected operational regimes. For example, during operation of the engine 20, tests conducted to evaluate the temperatures, pressures and status may be conducted In addition, during selected operational regimes of the engine 20 data may be collected on the current operation of fuel system 60, electrical system 90 and engine 20 to supplement and build trend data. The type of faults and degradation of the engine performance to be identified may be based on system responses to predetermined commands, modeled expected behavior, constraints or limits of operation and the like. Such algorithms can identify specific parameters associated with the engine and fuel subsystem models trend them using historical data, and map them to specific failures.

Continuing now with FIG. 7, for details of the diagnosing and adaptive control method 200, for controlling rotor blade tip 35 sealing. In an embodiment, the method is initiated by disposing a first electrode 12 at the casing of the gas turbine engine 20 as shown at 205. At process step, 210 one or more rotating blades are configured as the second electrode 11. In general, this will include grounding the rotating blade 31 to the same potential as the excitation source 18. The excitation source 18 is operably connected to the two electrodes 11, and 12. An excitation signal is transmitted to the DBDPA 110 disposed on a gas turbine engine 20 as shown at process step 230. The excitation signal is then provided to the actuator 110 to form a plasma and thereby generate airflow as depicted at process step 240 and described herein.

In addition, optionally the sensor measurements from various sensors 62 are received by the controller 106 of the engine control system 100 as shown at process step 220. Continuing with the method 200 at process step 225 the condition of the engine is diagnosed based on a the measured information from the sensors 62 as well as comparison of the received sensor signals and engine parameters or data from existing known good data to provide a means for determining the operating state of the engine 20. For example, measurements of temperature, pressure, fuel burn and the like may provide an indication of the efficiency of the engine 20. In another embodiment, the information provided regarding the operation of the DBDPA 110 may also be employed. In another embodiment, a number of detections beyond a selected duration may be sufficient. For example, detection of pressures and temperatures for a number of seconds or minutes. Moreover, periodic measurements of the performance of the engine 20 provides data points trending away from the established "baseline" measurement for a standard engine. This provides additional "historical data" that can be used for lifetime predictions of components in the gas turbine engine 20. Finally, the information regarding diagnosis and engine conditions may also be employed when generating the excitation signal for the actuator 110 as discussed above and depicted at process step 230.

To avoid frequent "nuisance faults" in an embodiment, the sensor 62, DBDPA 110 may be designed to signal the engine's control system 100 as described below and aircraft on-board computers only after a certain predetermined threshold has been exceeded. This input can be synchronized with the on-board Prognostics and Health Management (PHM) to provide predictive diagnostics for preventive engine maintenance. For example, in one embodiment, when a preset threshold is reached during operation of the engine, the signal can set a latched input which upon WOW=1 (i.e. "weight on wheels," upon aircraft landing) remains latched until the ground maintenance crew replace or adjust the DBDPA 110 to ensure the seals are operating as desired. Upon completion of the necessary repair/replacement, the signal is unlatched in the PHM system.

Advantageously, the described embodiments provided technical benefits of providing a non-contacting uniform aerodynamic seal with a dielectric barrier plasma actuator. In addition, such a seal along with sensors and the actuator permits pro-active preventive maintenance due to PHM trending. As a result, the gas turbine engine exhibits improved efficiency and reliability of all components in the airstream and eliminates or minimizes the need for rubbing or contacting type seals. Finally, as an overall system, clearance tolerances may be relaxed permitting easier manufacturing of components for the engine.

In terms of hardware architecture, such a computing device can include a processor, memory, and one or more input and/or output (I/O) device interface(s) that are communicatively coupled via a local interface. The local interface can include, for example but not limited to, one or more buses and/or other wired or wireless connections. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

When the computing device is in operation, the processor can be configured to execute software stored within the memory, to communicate data to and from the memory, and to generally control operations of the computing device pursuant to the software. Software in memory, in whole or in part, is read by the processor, perhaps buffered within the processor, and then executed. The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set), or generally any device for executing software.

The memory can include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory may incorporate electronic, magnetic, optical, and/or other types of storage media. Note that the memory can also have a distributed architecture, where various components are situated remotely from one another, but can be accessed by the processor.

The software in the memory may include one or more separate programs, each of which includes an ordered listing of executable instructions for implementing logical functions. A system component embodied as software may also be construed as a source program, executable program (object code), script, or any other entity comprising a set of instructions to be performed. When constructed as a source program, the program is translated via a compiler, assembler, interpreter, or the like, which may or may not be included within the memory.

The Input/Output devices that may be coupled to system I/O Interface(s) may include input devices, such as a keyboard, mouse, scanner, microphone, camera, proximity device, etc. Further, the Input/Output devices may also include output devices, for example but not limited to, a printer, display, etc. Finally, the Input/Output devices may further include devices that communicate both as inputs and outputs, for instance, but not limited to, a modulator/demodulator (modem; for accessing another device, system, or network), a radio frequency (RF) or other transceiver, a telephonic interface, a bridge, a router, etc.

One should note that the FIGS. 6 and 7 show the architecture, functionality, and/or operation of a possible implementation of software. In this regard, one or more of the blocks can be interpreted to represent a module, segment, or portion of code, which comprises one or more executable instructions for implementing the specified logical function(s). It should also be noted that in some alternative implementations, the functions noted in the blocks may occur out of the order and/or not at all. For example, two blocks shown in succession may in fact be executed substantially concurrently or the blocks may sometimes be executed in the reverse order, depending upon the functionality involved.

One should note that any of the functionality described herein can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device. The computer readable medium can be, for example but not limited to, an electronic, magnetic, optical, electromagnetic, infrared, or semiconductor system, apparatus, or device. More specific examples (a non-exhaustive list) of a computer-readable medium include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising." when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A non-contacting method for aerodynamically sealing rotating and fixed components of a gas turbine engine with a dielectric barrier discharge plasma actuator having a first electrode and a second electrode, the method comprising:

disposing the first electrode circumferentially on a casing of the gas turbine engine, the first electrode comprising at least one section of substantially flat conductive material encased in a dielectric material generally forming a cylinder;

configuring a rotating portion of the gas turbine engine as the second electrode;

operably connecting an excitation source between the first electrode and the second electrode; and generating an excitation signal with the excitation source and applying it to the first and second electrode to cause the actuator to form plasma between the first and second electrode, the plasma inducing an airflow between the casing and the rotating portion, wherein the disposing includes applying the first electrode to at least a portion of an inner circumference of the casing such that the first electrode extends continuously thereabout and forms a cylinder around a circumference of the casing.

2. The method of claim 1, wherein the disposing includes placing the first electrode forward axially of the second electrode, and thereby the plasma generated is uniform along an entire circumference of the casing and induces an airflow forward axially.

3. The method of claim 1, wherein the plasma is substantially uniform in at least one of an entire circumference of the casing and an axial direction.

4. The method of claim 1, wherein the generating includes grounding a rotating blade included with the rotating portion to a ground potential such that the rotating blade itself is configured as the second electrode, and providing an alternating current (AC) signal to the actuator.

5. The method of claim 1, wherein the rotating portion is at least on one of a fan blade, a compressor blade, a turbine blade, and a raised portion on a spool.

6. The method of claim 1, further including executing a method to control excitation signal to the actuator to control and manipulate the plasma generated and thereby the airflow induced, wherein the control is based on an operating condition of the gas turbine engine.

7. The method of claim 1, further including measuring an operating parameter of the gas turbine engine.

8. The method of claim 7, further including diagnosing a condition of the gas turbine engine based on at least the measuring of the operating parameter of the gas turbine engine.

9. The method of claim 8, wherein the diagnosing includes at least one of collecting data over time to facilitate making lifetime predictions of performance of the gas turbine engine.

10. The system of claim 1, wherein, the plasma is substantially uniform in at least one of an entire circumference of the casing and an axial direction.

11. A system for aerodynamically sealing rotating and fixed components of a gas turbine engine comprising:

a gas turbine engine having a casing and a rotating portion;

a dielectric barrier discharge plasma actuator having a first electrode and a second electrode, the first electrode disposed circumferentially on the casing of the gas turbine engine, the first electrode comprising at least one section of substantially flat conductive material encased in a dielectric material generally forming at least a portion of a cylinder;

a rotating portion configured as the second electrode; and an excitation source operably connected between the first electrode and the second electrode, the excitation source generating an excitation signal and applying it to the first and second electrode to cause the actuator to form plasma between the first and second electrode, the plasma inducing an airflow between the casing and the rotating portion, wherein the first electrode is disposed on at least a portion of an inner circumference of the casing and extends continuously thereabout so as to form a cylinder around a circumference of the casing.

12. The system of claim 11, wherein the first electrode is placed forward axially of the second electrode.

13. The system of claim 11, wherein the rotating portion includes at least on one of a fan blade, a compressor blade, a turbine blade, and a raised portion on a spool.

14. The system of claim 11, wherein the rotating portion is including a plurality of stages of a plurality of rotating blades.

15. The system of claim 11, wherein a rotating blade included with the rotating portion is coupled to a ground potential such that the rotating blade itself is the second electrode, and wherein the excitation signal is an alternating current (AC) signal with its common or ground connected to the second electrode.

16. The system of claim 15, wherein the alternating current (AC) signal is at least one of a sinusoid and exhibits a frequency sufficiently high in relation to any relevant dynamics for the flow, so that an associated aerodynamic force produced by plasma 30 is effectively steady state.

17. The system of claim 11, further including a controller operably connected to at least one of the actuator, the excitation source, and a plurality of sensors configured to measure an operating parameter of the gas turbine engine.

18. The system of claim 17, wherein the controller includes the excitation source.

19. The system of claim 17, further including the controller executing a method to control excitation signal to the actuator to control and manipulate the plasma generated and thereby the airflow induced, wherein the control is based on an operating condition of the gas turbine engine.

20. The system of claim 19, further including the controller executing a method to diagnose a condition of the gas turbine engine based on at least the measuring of an operating parameter of the gas turbine engine.

21. The system of claim 20, wherein the diagnosing includes at least one of collecting data over time to facilitate making lifetime predictions of performance of the gas turbine engine.

* * * * *